United States Patent [19]

Gillpatrick

[11] 4,085,727

[45] Apr. 25, 1978

[54] AIR CIRCULATING HEATER FOR FIREPLACES

[76] Inventor: Sherman R. Gillpatrick, 402 Chambers #54, El Cajon, Calif. 92020

[21] Appl. No.: 701,232

[22] Filed: Jun. 30, 1976

[51] Int. Cl.[2] ..... F24B 7/02

[52] U.S. Cl. ..... 126/121; 126/63; 126/66; 126/143

[58] Field of Search ..... 126/121, 122, 143, 61, 126/63, 66, 88, 90 R, 67, 6, 69, 70, 110 B, 110 R; 237/51; 165/126

[56] References Cited

U.S. PATENT DOCUMENTS

| | | | |
|---|---|---|---|
| 1,640,937 | 8/1927 | Heinish | 126/121 |
| 2,743,720 | 5/1956 | Dollinger | 126/121 |
| 2,744,516 | 5/1956 | Hubbard | 126/110 B |
| 3,190,282 | 6/1965 | Bauer | 126/121 X |
| 3,452,737 | 7/1969 | Pellegrino et al. | 126/121 |
| 4,008,706 | 2/1977 | Buanno | 126/121 |

FOREIGN PATENT DOCUMENTS

| | | | |
|---|---|---|---|
| 136,452 | 2/1950 | Australia | 126/121 |
| 661,824 | 7/1929 | France | 126/121 |
| 606,702 | 4/1959 | Italy | 126/120 |
| 74,394 | 12/1948 | Norway | 126/121 |
| 622,417 | 5/1949 | United Kingdom | 126/121 |

*Primary Examiner*—William F. O'Dea
*Assistant Examiner*—Harold Joyce
*Attorney, Agent, or Firm*—W. Britton Moore

[57] ABSTRACT

An air circulating heater including a walled enclosure covered by a fire plate and adapted to be inserted within a regular or below a self-standing fireplace. A circulating fan is positioned behind a louvered front panel so that cold room air is drawn thereinto and directed upwardly and rearwardly by fan shaped baffles on the underside of the fire plate. The cold air is heated through the fire plate by heat within the fireplace and the heated air is returned to the room through the louvered panel.

7 Claims, 5 Drawing Figures

AIR CIRCULATING HEATER FOR FIREPLACES

This invention relates to an air circulating heater for regular and self-standing fireplaces.

Heretofore, heating units have been provided for fireplaces which have largely occupied all of the fireplace area and usually necessitated bulky, cumbersome and weighty permanent installations. Units of this type are represented by U.S. Pat. Nos. 2,131,763 to Sroat, Kraus 2,296,354, Dollinger 2,743,720 and Bauer 3,190,282.

Accordingly, it is the principal object of the present invention to provide an air curculating heater for regular and self-standing fireplaces including a walled and fire plate covered enclosure for removable insertion within or below a fireplace, and through which cold room air is caused to be circulated and heated through the fireplate and returned to the room.

A further object is the provision of a heater enclosure including a louvered front panel with a circulating fan positioned therebehind so that cold room air is circulated therethrough and heated through a fireplate by heat within the fireplace.

Another object is the provision of a novel fireplate covering for the heater enclosure having fan-shaped baffles on its underside for circulating the cold air directed upwardly thereagainst rearwardly and outwardly.

Still another object is to provide a box-like self-contained air circulating heater enclosure adapted to be removably inserted within a regular or below a self-standing fireplace so that the usual wood or coal fire within the fireplace may be built on the fireplate cover and the air circulating therebelow is heated and returned to the room.

A still further object is the provision of a relatively light and easily handled self-contained air circulating heater enclosure which may be readily installed within and removed from fireplaces.

These and other objects and advantages will be apparent as the following specification is considered with the accompanying drawings, wherein FIG. 1 is a front elevation of an air circulating heater enclosure installed in a regular fireplace.

Figure 1:
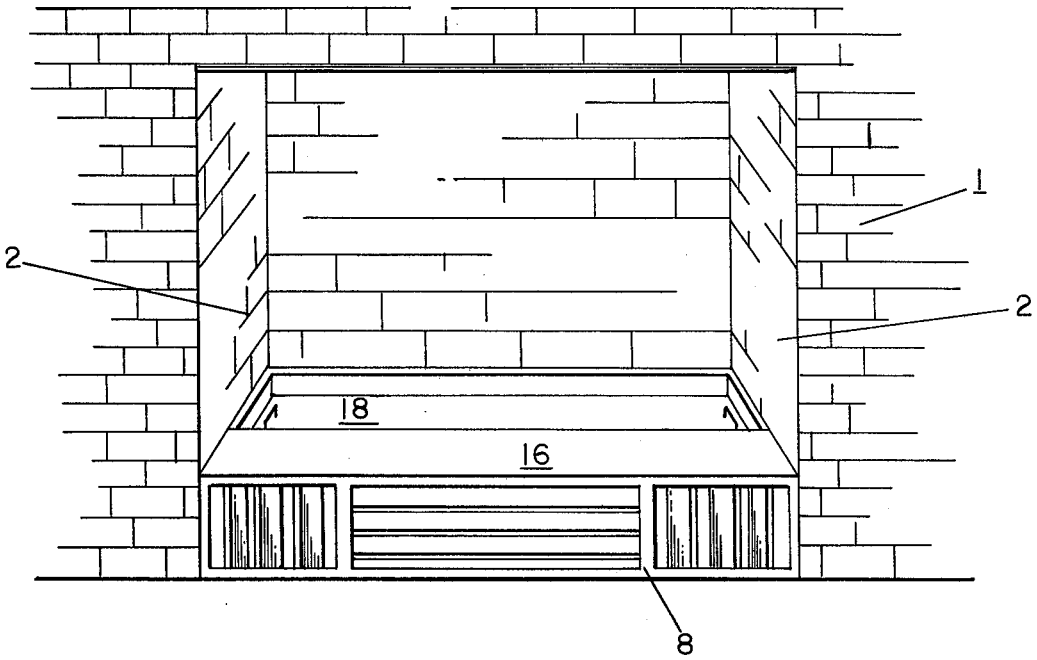
Figure 2:
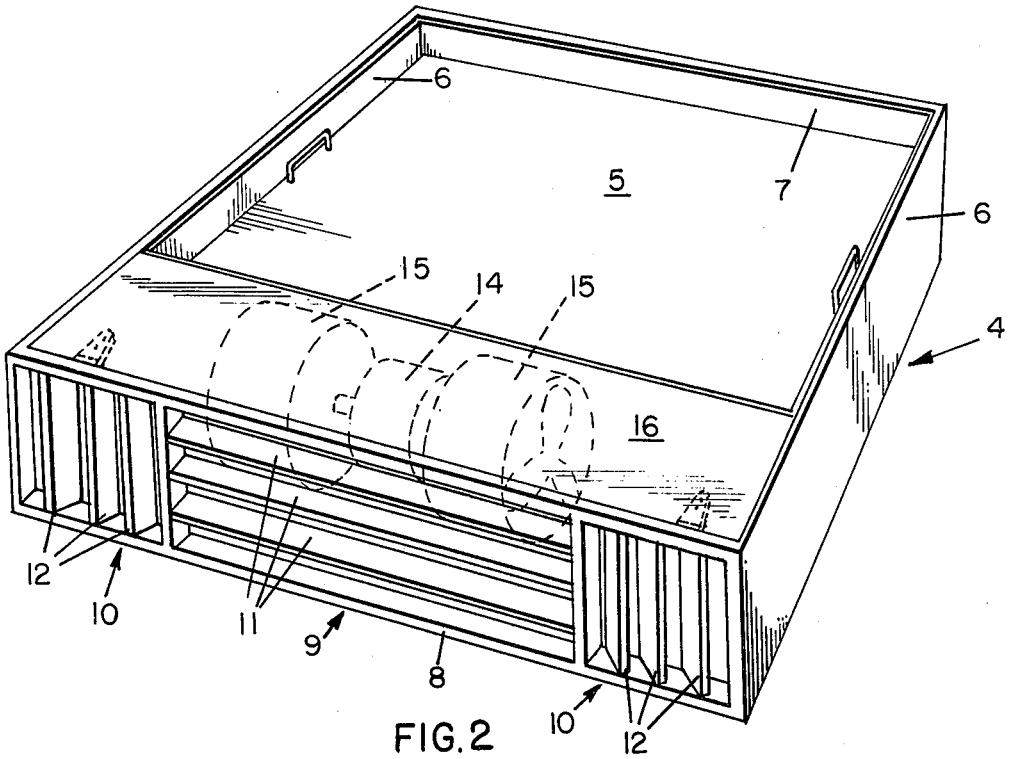
FIG. 2 is a perspective view of the heater enclosure with the fireplate removed therefrom.
Figure 3:
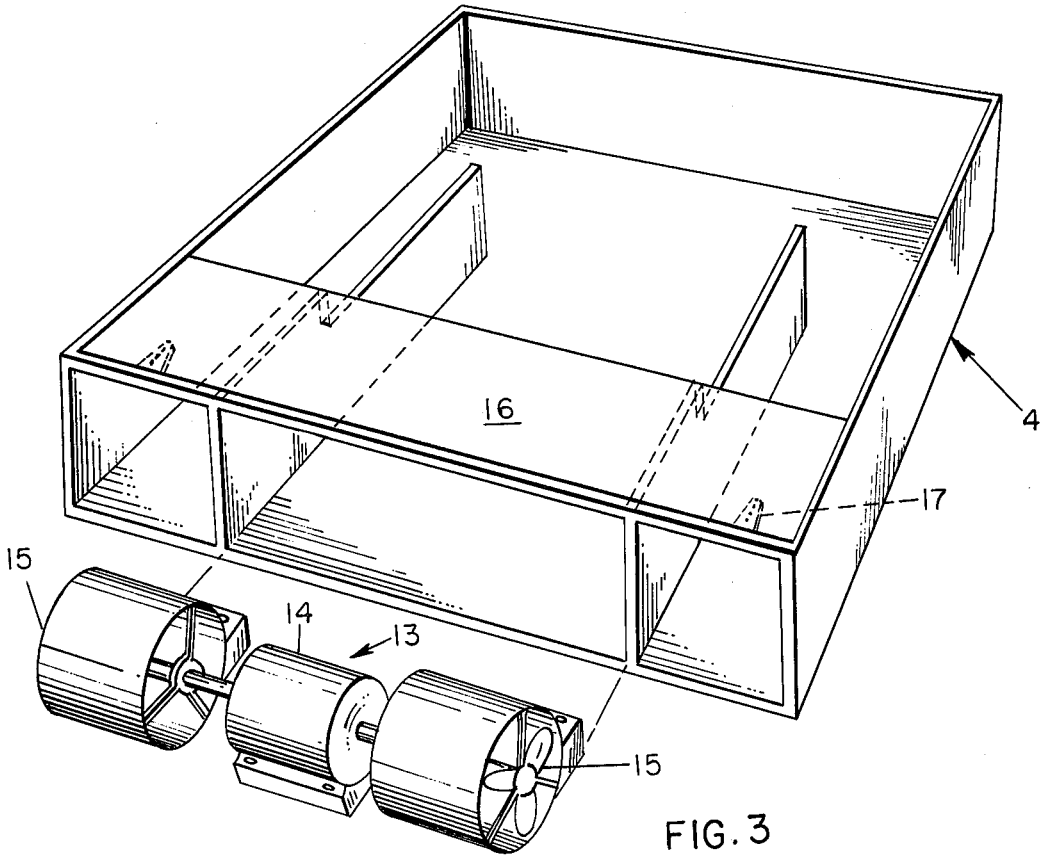
FIG. 3 is a perspective view of the heater enclosure with the air circulating fan removed therefrom and positioned in front thereof.

Referring more particularly to the drawings, wherein similar reference characters designate like parts throughout the several views, numeral 1 generally represents a regular wall or chimney type fireplace including side 2 and rear walls 3 from which the usual grate and andirons have been removed. The present metal heater enclosure 4 is arranged on the floor of the fireplace and generally conforms to the inside dimensions of the fireplace. This enclosure 4 is generally rectangular in shape and is provided with a flat bottom wall 5, relatively shallow sides 6 and rear wall 7, and a front panel 8. The latter is provided with three louvered areas, a central louvered area 9 extending across the central portion of the panel, and end louvered areas 10 on either side thereof. Louvers 11 in the central area 9 extend transversely and project upwardly and inwardly at an angle, and louvers 12 in the end areas 10 are vertically arranged and project laterally in opposing directions, for a purpose presently to be described.

A conventional double air circulating fan 13 including electric motor 14 and dual fans 15 is suitably attached to bottom wall 5 to the rear of the louvered front panel 8 and extends generally across the central louvered area 9 thereof. A cover 16 may be suitably hinged, as at 17, to the front of the heater enclosure and serves to enclose and protect the fan, and afford ready access thereto. The area to the rear of cover 16 is open so as to accommodate a flat relatively heavy, gauge metal fireplate 18. As the side walls 2 of the conventional fireplace taper inwardly from front to rear, the side walls 2 of the heater enclosure and the side edges of fireplate 18 are correspondingly angled so that the enclosure and its fireplate snugly interfit the fireplace, in an obvious manner. The fireplate may be removably connected to the enclosure, or may be freely positioned thereon and retained by its own weight and is provided with handles 19 to facilitate handling. It will, of course, be apparent that the electric fan motor 14 is connected by the usual conductor cord to a source of power, neither of which is shown.

Figure 4:
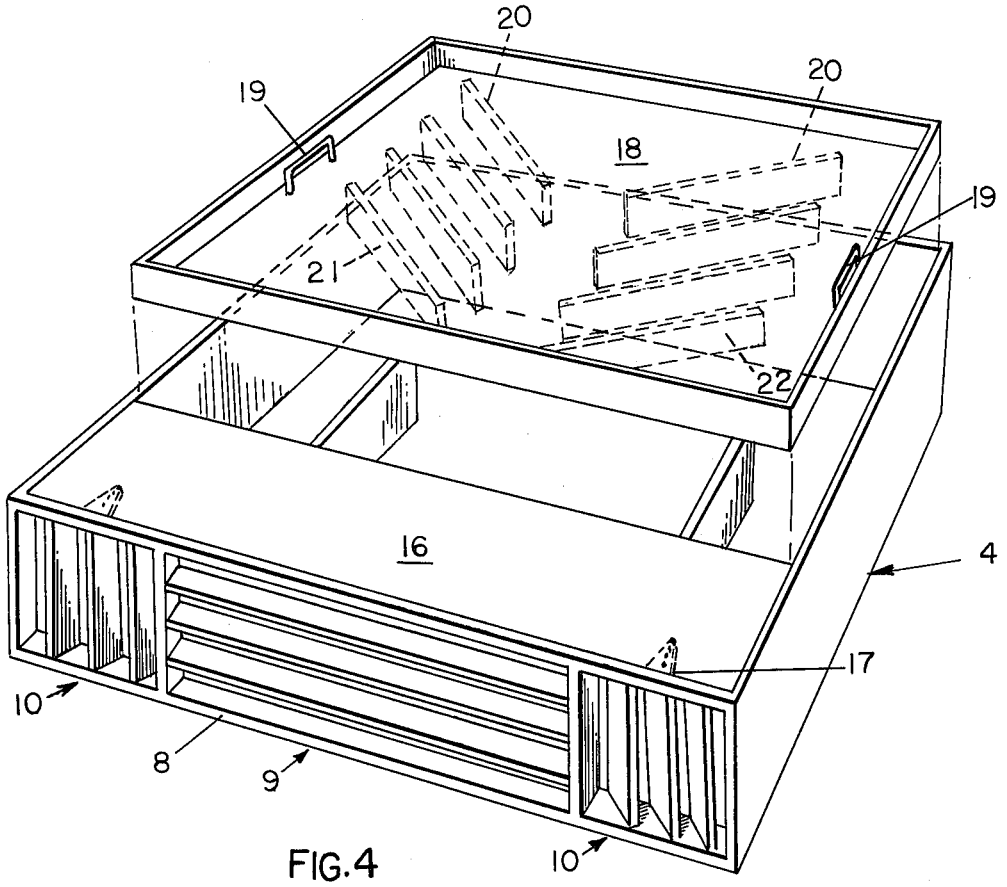
FIG. 4 is an exploded view of the heater enclosure and cover fireplate.

Disposed on and suitably attached by welding or the like to the underside of fireplate 18 are a series of spaced downwardly depending baffle plates 20, arranged in two spaced groups 21–22 extending outwardly and rearwardly in opposing directions and constituting a generally fan-shaped baffle area, as perhaps best shown in FIG. 4, and for a purpose hereinafter to be described.

Figure 5:
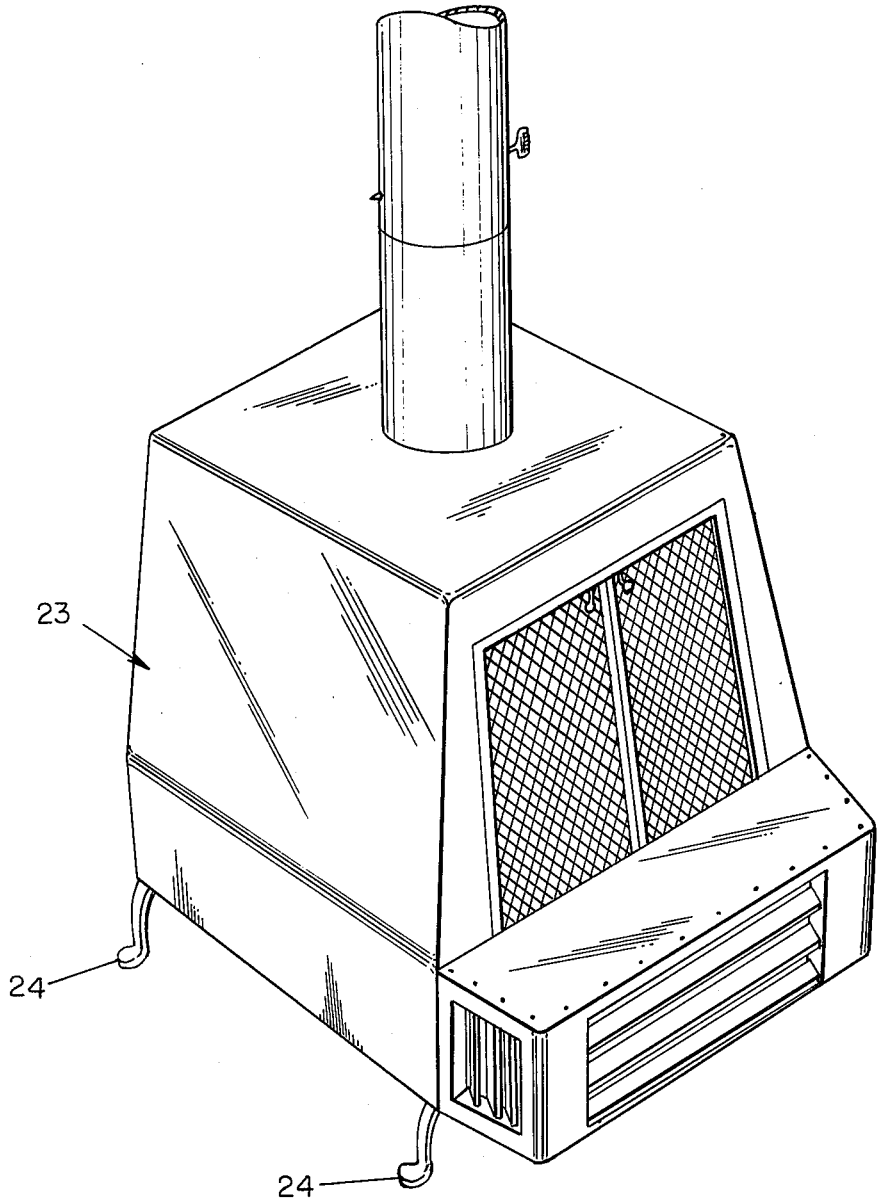
FIG. 5 is an embodiment of the heater enclosure as applied to a free-standing fireplace.

In the embodiment of FIG. 5, the heater enclosure is adapted to be used in conjunction with a free standing type fireplace 23, in which instance the fireplace will be positioned on the fireplate of the heater enclosure, and the latter may be provided with legs 24 to elevate it above the floor. In this embodiment, the fireplace will probably be positioned on the fireplate to the rear of cover 16, so that the fan compartment portion of the enclosure and the louvered front panel will project forwardly of the fireplace. Thus, it may be desirable to provide the central louvered area 9 in the front panel of the enclosure and the end louvered areas 10 in the sides thereof. While the louvers in central area 9 will remain as in the embodiment of FIG. 1, the louvers in side areas 10 will extend angularly forwardly so as to direct the warm air outwardly thereof and into the room area.

As the units installed in regular fireplace 1 and free standing fireplace 23 function in the same manner, only the former need be described. Thus, with heater enclosure 4 positioned within fireplace 1 and fire wood arranged in the usual grate on fireplate 18 ignited, heat therefrom will be transmited through the fireplate and into the heater enclosure. With circulating fan 13 plugged into its power source and functioning, cold or unheated air from the room is drawn through the central louvered area 9 and directed upwardly by louvers 11 towards the baffle plates 20 on the underside of the fireplate. As the baffles 20 extend rearwardly and fanwise, the air will circulate therethrough in streams until contacting the side and rear walls from which it will be redirected forwardly and caused to exit into the room area through the louvers 12 in the end louvered areas 10 of front panel 8. During this circulation through the enclosure, the cold air will be heated and so returned to the room. The opposing angular arrangement of louvers 12 will direct the heated air outwardly and laterally away from the incoming cold air entering central louvered area 9.

It is to be noted that the sides 6 and rear walls 7 and front louvered panel 8 are relatively shallow so that as the enclosure is generally rectangular in shape and has a very low profile, it will readily and snugly fit within regular fireplace 1, or accommodate free standing fireplace 23 thereon, without occupying much space of fireplace 1, or unduly increasing the height of fireplace 23. In addition, this arrangement provides a compact, light, and easily handled enclosure which may be readily installed in or removed from either type fireplace.

While two embodiments of my air circulating heater enclosure have been shown and described, it is to be understood that various revisions may be made therein without departing from the scope and spirit of the appended claims.

What I claim is:

1. An air circulating heater for a fireplace comprising a generally rectangular metal enclosure having a floor, and side and rear walls, and a front panel, said panel having central inlet louvered and end air discharge louvered areas, said enclosure being relatively shallow in height for positioning on the floor and in the bottom of said fireplace, a cover hinged to said enclosure and covering only the front portion thereof, electrical circulating fan means connected to a source of power and arranged in said enclosure beneath said cover and to the rear of said central louvered panel area, a flat metal fireplate arranged on said enclosure to the rear of said cover for heating air flowing therebeneath in said enclosure, and baffle plate means formed on the underside of said fireplate and extending into said enclosure for circulating air rearwardly and thence forwardly of said enclosure, cold air from the room being drawn through said central louvered panel area into said enclosure and directed through said baffle plate means for heating and recirculating through said enclosure and return to the room through said end discharge louvered areas.

2. An air circulating heater for a fireplace as defined in claim 1, wherein the louvers in said central areas extend transversely and project upwardly and rearwardly at an angle.

3. An air circulating heater for a fireplace as defined in claim 2, wherein the louvers in said end areas extend vertically and oppositely and inwardly and angularly.

4. An air circulating heater for a fireplace as defined in claim 1, wherein said circulating fan means includes dual fans, and said fan means is arranged on said floor to the rear of and adjacent to said central louvered area.

5. An air circulating heater for a fireplace as defined in claim 1, wherein said enclosure generally conforms to the area of said fireplace and is arranged on the floor thereof whereby heat from the fireplace is transmitted through said fireplate and to heat air being circulated therethrough by said fan means.

6. An air circulating heater for a fireplace as defined in claim 1, wherein said baffle plate means on said fireplate are arranged in two oppositely and angularly extending groups to direct air being circulated through said enclosure laterally and rearwardly.

7. An air circulating heater for a fireplace as defined in claim 6, wherein the louvers in said central panel area extend transversely and upwardly and inwardly at angles whereby incoming cold air is directed upwardly and rearwardly into engagement with said baffle plate means.

* * * * *